US008893608B2

(12) United States Patent
Kramer

(10) Patent No.: US 8,893,608 B2
(45) Date of Patent: Nov. 25, 2014

(54) GAS PISTON SYSTEM FOR M16/AR15 RIFLE OR M4 CARBINE SYSTEMS

(71) Applicant: Lawrence S. Kramer, Las Vegas, NV (US)

(72) Inventor: Lawrence S. Kramer, Las Vegas, NV (US)

( * ) Notice: Subject to any disclaimer, the term of this patent is extended or adjusted under 35 U.S.C. 154(b) by 0 days.

(21) Appl. No.: 13/933,439

(22) Filed: Jul. 2, 2013

(65) Prior Publication Data

US 2014/0076151 A1 Mar. 20, 2014

Related U.S. Application Data

(60) Provisional application No. 61/667,910, filed on Jul. 3, 2012.

(51) Int. Cl.
*F41A 5/26* (2006.01)

(52) U.S. Cl.
CPC ..... *F41A 5/26* (2013.01)
USPC ..... 89/193

(58) Field of Classification Search
CPC ..... F41A 5/18; F41A 5/20; F41A 5/24; F41A 5/26; F41A 5/28
USPC ..... 89/191.01, 191.02, 192, 193
See application file for complete search history.

(56) References Cited

U.S. PATENT DOCUMENTS

| | | | | |
|---|---|---|---|---|
| 2,582,989 | A * | 1/1952 | Harvey | 89/193 |
| 2,951,424 | A | 9/1960 | Stoner | |
| 3,592,101 | A * | 7/1971 | Vartanian et al. | 89/193 |
| 3,776,095 | A | 12/1973 | Atchisson | |
| 3,955,469 | A * | 5/1976 | Conley | 89/33.14 |
| 4,244,273 | A * | 1/1981 | Langendorfer et al. | 89/193 |
| 5,177,320 | A * | 1/1993 | Reynolds | 89/193 |
| 5,351,598 | A | 10/1994 | Schuetz | |
| 5,404,790 | A * | 4/1995 | Averbukh | 89/193 |
| 5,824,943 | A * | 10/1998 | Guhring et al. | 89/192 |
| 7,779,743 | B2 | 8/2010 | Herring | |
| 2002/0073832 | A1 * | 6/2002 | Vignaroli et al. | 89/191.01 |
| 2005/0262752 | A1 | 12/2005 | Robinson et al. | |
| 2009/0211483 | A1 | 8/2009 | Kramer | |
| 2009/0229454 | A1 * | 9/2009 | Fluhr et al. | 89/193 |
| 2011/0005383 | A1 | 1/2011 | Kramer | |
| 2011/0094373 | A1 * | 4/2011 | Cassels | 89/191.01 |
| 2013/0025445 | A1 * | 1/2013 | Windauer | 89/193 |

* cited by examiner

*Primary Examiner* — Bret Hayes

(74) *Attorney, Agent, or Firm* — Patterson & Sheridan, L.L.P.

(57) ABSTRACT

A gas piston system for a firearm includes a gas block having a port in communication with the barrel port and an exhaust tube. The exhaust tube has: a head at least partially disposed in the gas block and having a port in fluid communication with the gas block port; a body extending from the head toward a muzzle of the firearm; and a channel extending from the exhaust tube port through the body. The gas piston system further includes a driver movable relative to the gas block between a forward and rearward position and having: a piston slidable along the gas block; a stinger closing the channel in the forward position and opening the channel in the rearward position, and an operating rod operable to push the bolt carrier assembly away from the barrel.

15 Claims, 7 Drawing Sheets

1

| BULLET DIAMETER (mm) | 6.8 | 6 | 6.5 | 7.62 | 6.5 MAG | 6.8 MAG |
|---|---|---|---|---|---|---|
| A(in.) | 1.700 | 1.700 | 1.700 | 1.670 | 1.700 | 1.700 |
| B(in.) | 1.540 | 1.555 | 1.555 | 1.500 | 1.555 | 1.540 |
| C(in.) | 1.437 | 1.437 | 1.437 | 1.437 | 1.464 | 1.464 |
| D(in.) | 0.149 | 0.149 | 0.149 | 0.149 | 0.149 | 0.149 |
| E(in.) | 0.303 | 0.269 | 0.290 | 0.334 | 0.290 | 0.303 |
| F(in.) | 0.303 | 0.269 | 0.290 | 0.334 | 0.290 | 0.303 |
| G(in.) | 0.353 | 0.353 | 0.353 | 0.353 | 0.357 | 0.357 |
| H(in.) | 0.376 | 0.376 | 0.376 | 0.376 | 0.375 | 0.375 |
| I (in.) | 0.378 | 0.378 | 0.378 | 0.378 | 0.378 | 0.378 |
| α (deg.) | 23 | 23 | 23 | 23 | 23 | 23 |
| NT(in.) | 0.013 | 0.013 | 0.013 | 0.013 | 0.013 | 0.013 |
| CL(in.) | 2.260 | 2.260 | 2.260 | 2.260 | 2.260 | 2.260 |

FIG. 6B

| CARTRIDGE | DIMENSIONS (inches or deg.) | | | | | | | | | | | | |
|---|---|---|---|---|---|---|---|---|---|---|---|---|---|
| | A | B | C | D | E | F | G | H | I | a | NL (APX) | NW | COL (MAX) |
| 5.7 mm / 224 cal. | 1.700 | 1.500 | 1.250 | .150 | .254 | .254 | .454 | .470 | .473 | 20 | .200 | .0165 | 2.260 |
| 6 mm / 243 cal. | 1.700 | 1.500 | 1.250 | .150 | .276 | .276 | .454 | .470 | .473 | 20 | .200 | .0165 | 2.260 |
| 6.5 mm / 264 cal. | 1.700 | 1.500 | 1.270 | .150 | .297 | .297 | .454 | .470 | .473 | 20 | .200 | .0165 | 2.260 |
| 6.8 mm / 277 cal. | 1.700 | 1.500 | 1.295 | .150 | .308 | .308 | .454 | .470 | .473 | 20 | .200 | .0155 | 2.260 |
| 7.62 mm / 308 cal. | 1.700 | 1.500 | 1.325 | .150 | .343 | .343 | .454 | .470 | .473 | 20 | .200 | .0175 | 2.260 |
| 8.6 mm / 338 cal. | 1.700 | 1.500 | 1.325 | .150 | .364 | .364 | .454 | .470 | .473 | 20 | .200 | .0130 | 2.260 |

FIG. 6C

GAS PISTON SYSTEM FOR M16/AR15 RIFLE OR M4 CARBINE SYSTEMS

BACKGROUND OF THE DISCLOSURE

1. Field of the Disclosure

Embodiments of the present disclosure relate generally to a gas piston system for a firearm.

2. Description of the Related Art

FIGS. 1A and 1B illustrate a prior art M16 rifle. The M16 rifle includes an upper receiver 50 hinged to a lower receiver 51 at a pivot pin 52. A removable pin 53 extends through the lower receiver to hold the upper receiver 50 in place. A charging handle 54 at the rear of the upper receiver is provided for charging the weapon. Automatic and semi-automatic operation of the weapon is achieved by a gas tube 56 extending from a forward portion of the barrel 57 to the receiver. A removable ammunition magazine 58 is inserted in the lower receiver.

The upper receiver 50 has a hinge aperture 65 for receiving the hinge pin 52, and a downwardly extending boss 66 having an aperture 67 for receiving the retaining pin 53. The gas tube 56 extends through the front of the upper receiver 50 and enters a gas chamber 68 for affecting the backward movement of a bolt carrier 55 upon the firing of a cartridge 76. The bolt carrier 55, upon firing, moves backwardly into the gunstock 69 against the action of a recoil spring 70 and buffer 71 in the stock. The charging handle 54 slidably extends into the upper receiver, and carries a projection 74 which engages a projection 72 on the bolt carrier 55 upon rearward movement of the charging handle 54, to affect the manual charging of the weapon. The charging handle 54 also has an elongated internal slot 73 for clearance of the bolt carrier 55 during operation of the weapon. An automatic sear 75 of conventional nature is provided in the lower receiver according to the conventional practice. The sear 75 is operated by the bolt carrier 55, for catching an upper hook 78 of the weapons hammer 77 during automatic operation of the weapon. In semi-automatic operation the trigger mechanism (not shown) of the weapon catches the lower hook 79 of the hammer. The cartridge 76 is in firing position in the firing chamber of barrel 57. The magazine 58 is held in the lower receiver so that cartridges are fed from the top of the magazine to the bolt upon forward movement of the bolt carrier 55.

The standard design gas system used in AR15 and M16 rifles and M4 carbines utilizes a direct gas impingement (DGI) system which directs expanding gas from the fired cartridge out of the barrel 57 through a gas port in the barrel. The expanding tapped gas is then directed through the gas tube 56 which directs the gas back into the upper receiver. The gas then enters the bolt carrier key forcing the bolt carrier 55 to the rear and unlocking the bolt, beginning the cycling process.

All gas piston systems operate in much the same way; they use propellant gases from the fired cartridge to actuate a piston, which pushes on a rod that cycles the weapon. Most gas piston systems currently available for the AR15 weapon system are retrofit systems made to convert the existing DGI equipped rifles and carbines to a piston system. These piston systems use the existing gas port location and gas port diameter already in place on the DGI configured weapons, making them desirable to owners of these commonly configured weapons.

Most all of these retrofit gas piston systems are also designed to operate with the most common cartridge found in the AR15 weapon platform, the 223 Remington (civilian designation) or the nearly identical 5.56×45 millimeter NATO (military designation) used in the M16 rifle and M4 carbine. These retrofit systems are able to work with existing gas port sizes and locations common to this weapon system mainly because the standard chambering mentioned above has enough "gas port pressure and volume" to activate the piston system. With any of the standard length systems; carbine length, mid length, or rifle length, a piston system generally requires more gas volume and pressure to operate than a DGI system.

The front end of the rifle and/or carbine, often referred to as the "hand guards", is standardized in three different lengths to coincide with the three gas system lengths found on DGI equipped guns. The gas block attached to the barrel where the gas is "tapped" from the barrel is located just in front of the hand guards, this is also where the gas blocks are for most piston systems. Because the gas blocks are out in front of the hand guards on the barrel the size of the components can be adjusted or enlarged to give the desired performance. This is also the location for the exhaust port on all piston systems, where the hot and dirty propellant gases are discharged.

The fact that piston systems require more gas port pressure and volume to operate, and that most of them use the existing gas port locations and diameters means that they may not function reliably with all available brands and types of ammunition. This is because ammunition manufactures use many different types of propellants in their ammunition to obtain the best performance with the many different bullets weights and styles that are available.

Each propellant has its own burning characteristic and develops its own "pressure curve". The pressure curve in basic terms is the time it takes a specific propellant to reach its maximum pressure and how fast that pressure drops off as the bullets moves down the barrel; the charted profile of a propellant igniting, its build up of pressure, its maximum pressure, and drop in pressure is the pressure curve. Most gas ports in the barrels are located on the "down slope" of the pressure curve, if a given propellant is too far down its down slope by the time the bullet reaches the gas port the weapon will not have enough port pressure or volume to cycle the weapon.

With few exceptions, gas piston systems for the AR15 rifle work as long as the standard caliber (223 Remington/5.56-mm NATO) for this weapon system is used; in most loads this cartridge provides ample port pressure and volume to operate either system. If cycling or functioning problems occur with certain types of ammunition, then the piston components can be enlarged to give the system more force to operate the weapon and increase reliability because there is little size constraint out in front of the hand guards. Existing gas piston systems currently available for the AR15 rifle are adequate because most of these rifles are chambered for the standard cartridge mentioned above.

SUMMARY OF THE DISCLOSURE

Embodiments of the present disclosure relate generally to a gas piston system for a firearm. In one embodiment, a firearm includes: a barrel having a port formed through a wall thereof; a bolt carrier assembly operable to transport a cartridge from a magazine to the barrel and eject the spent cartridge from the barrel; and a gas piston system. The gas piston system includes a gas block having a port in communication with the barrel port and an exhaust tube. The exhaust tube has: a head at least partially disposed in the gas block and having a port in fluid communication with the gas block port; a body extending from the head toward a muzzle of the firearm; and a channel extending from the exhaust tube port through the body. The gas piston system further includes a driver movable relative to the gas block between a forward and rearward position and having: a piston slidable along the gas block; a stinger closing the channel in the forward position and opening the channel in the rearward position, and an operating rod operable to push the bolt carrier assembly away from the barrel.

In another embodiment, a gas piston system includes a gas block for mounting to a barrel of a firearm and having a port for communication with a port of the barrel and an exhaust tube. The exhaust tube has a head at least partially disposed in the gas block and having a port in fluid communication with the gas block port; a body extending from the head to a shoe; the shoe having a coupling; and a channel extending from the exhaust tube port through the body and the shoe. The gas piston system further includes an exhaust block for mounting to the barrel and having a coupling engaged with the shoe coupling and a driver. The driver is movable relative to the gas block between a forward and rearward position and has: a piston slidable along the gas block; a stinger closing the channel in the forward position and opening the channel in the rearward position, and an operating rod for extending to a bolt carrier assembly of the firearm. The gas piston system further includes a gas chamber formed in the gas block between the piston and the head.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 6A-6C illustrate cartridges suitable for use with the gas piston system.

DETAILED DESCRIPTION OF THE PREFERRED EMBODIMENT

The interest in a larger caliber AR15/M16 style rifle or M4 style carbine is increasing daily and the U.S. Military is also seeking a larger caliber option for this weapon system, and a gas piston system that will operate with it.

Problems arise in using a gas piston system on the M16/AR15 rifles and M4 carbines when "non-standard" calibers are used in this weapon. Larger caliber (bigger bore diameter) cartridges do not have the same port pressure or volume as the standard 223 Remington or 5.56-mm NATO chambering at the existing or standard gas port locations; larger calibers have reduced pressure and volume at the standard locations. Most all retrofit gas piston systems for the M16/AR15 rifle only work with the standard caliber and will not function with any other caliber.

The easiest solution to this problem is to move the gas port closer to the chamber and tap the gas from the barrel sooner where there is more port pressure, or "earlier" in the pressure curve. This is not easily done because the gas port locations have been standardized for some time, and the components for the rifle and carbines are also standardized and any changes would be costly. Because all of the components of the gas piston systems will not fit underneath the hand guards, the other components of the rifle would need to be customized and would be costly.

Figure 1A:
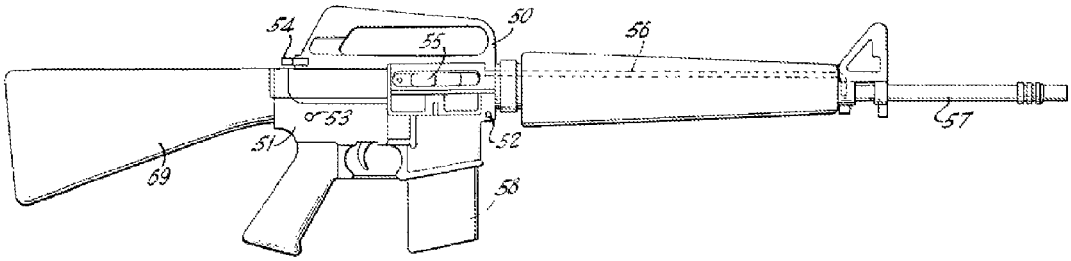
FIG. 1A (Prior Art)
FIGS. 1A and 1B illustrate a prior art M16 rifle.
Figure 1B:
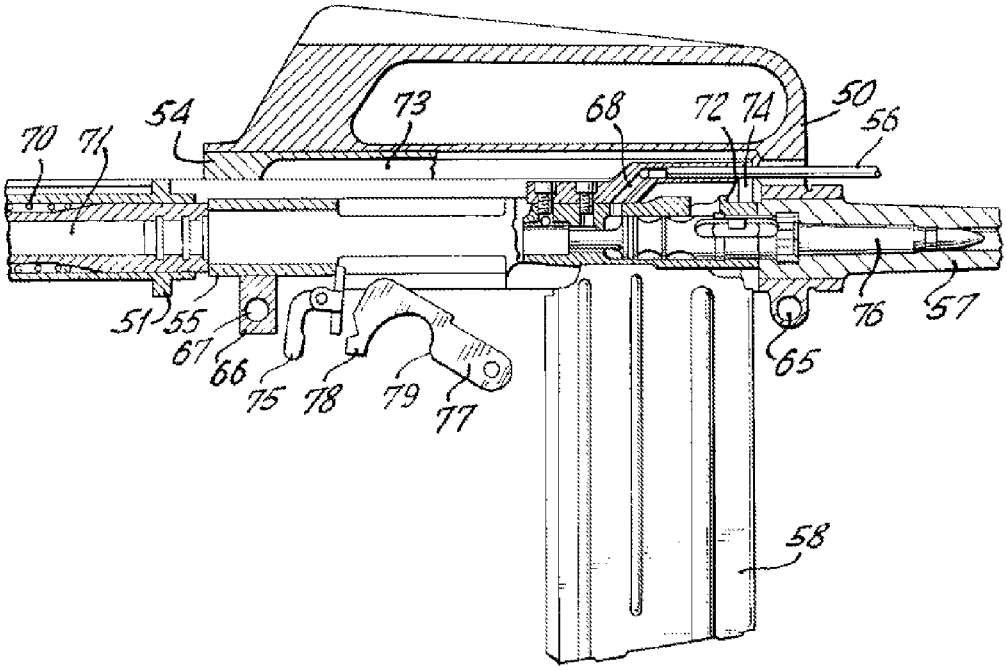
FIG. 1B (Prior Art)
Figure 2A:
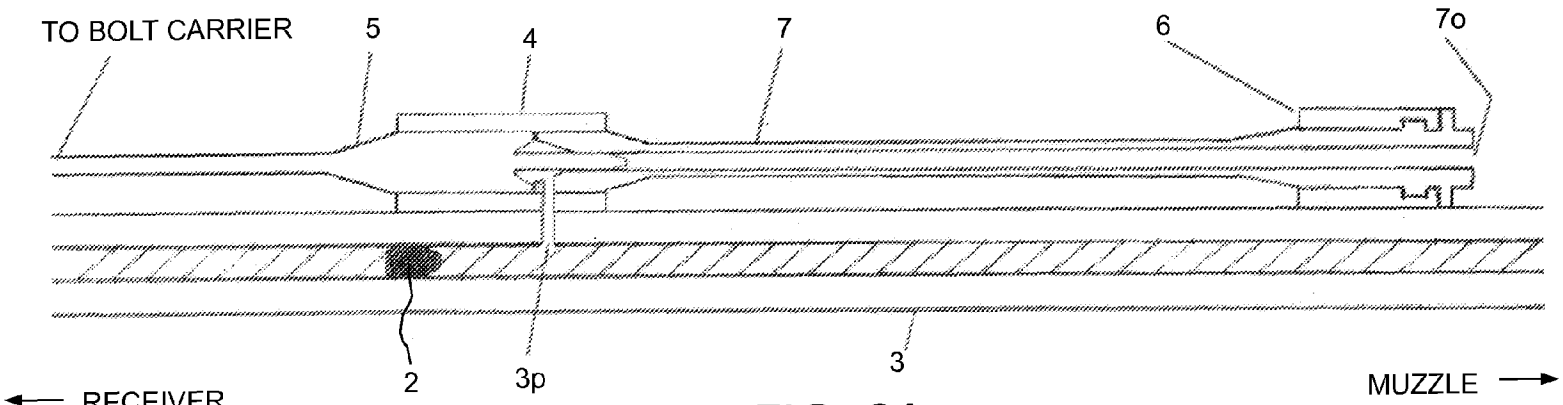
FIGS. 2A and 2B illustrate a gas piston system in a forward position, according to one embodiment of the disclosure.
Figure 2B:
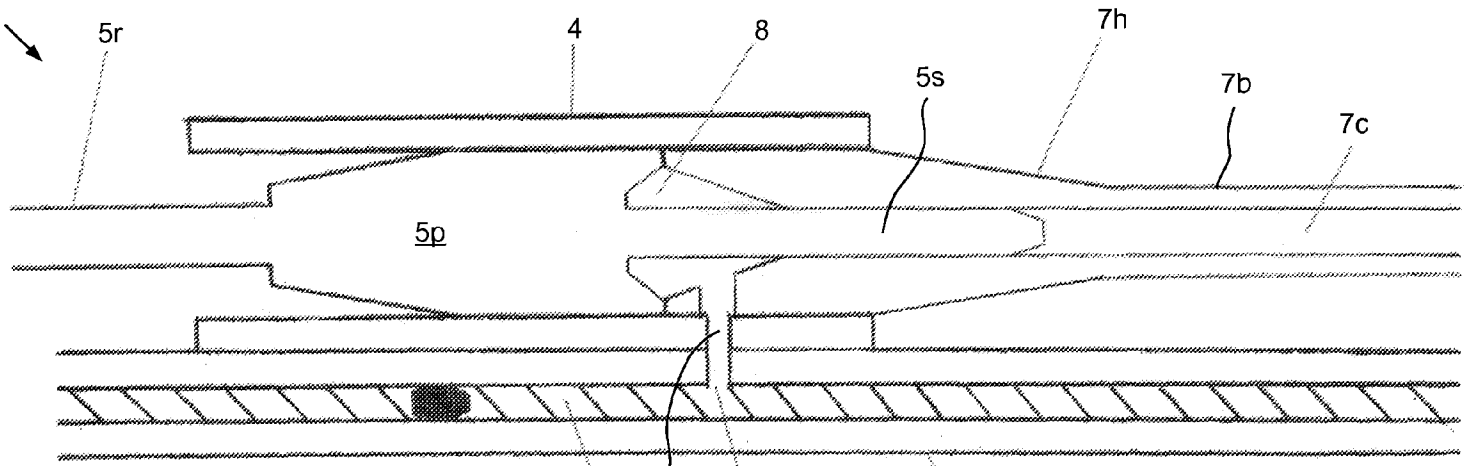

FIGS. 2A and 2B illustrate a gas piston system 1 in a forward position, according to one embodiment of the disclosure. The weapon has just fired and the bullet 2 has started down a rifled bore 3*b* of the barrel 3 but has not yet reached the gas port 3*p* in the barrel. The gas piston system 1 may include a gas block 4, a driver 5, an exhaust block 6, and an exhaust tube 7. The driver 5 may include a gas piston 5*p*, an operating rod 5*r*, and a stinger 5*s* formed integrally or connected together, such as by threaded couplings. The exhaust tube 7 may include a head 7*h*, a body 7*b*, and a shoe 7*s* (FIG. 3B) formed integrally or connected together, such as by threaded couplings.

The gas block 4 may be mounted to the barrel 3 such that a gas port 4*p* formed through a wall of the gas block is in alignment with the barrel gas port 3*p* and the exhaust tube 7 may be mounted in the gas block such that a gas port 7*p* (FIG. 3B) thereof is also in alignment, thereby providing fluid communication between the bore 3*b* and a gas chamber 8. Each of the blocks 4, 6 may be fastened, such as pinned, screwed, or bolted, to the barrel 3. The gas chamber 8 may be formed in the gas block 4 between the gas piston 5*p* and the exhaust head 7*h*. The gas port 3*p* may be located along the barrel 3 at any location between the firing chamber and the muzzle and may be optimized for a particular cartridge and/or propellant, such as closer to the firing chamber for a (modified) M4 carbine and farther from the firing chamber for a (modified) M16 rifle. The gas piston system 1 may even be small enough to fit under the hand guards. This flexibility allows the gas piston system 1 to reliably function with any cartridge and barrel length combination.

Interfaces between: the gas piston 5*p* and the gas block 4, the exhaust head 7*h* and the gas block, and the barrel 3 and the gas block may be sealed such that no propellant gas is discharged at the gas block. The stinger 5*s* may extend into a channel 7*c* of the exhaust tube 7 in the forward position, thereby isolating the exhaust channel from the gas chamber 8.

Figure 3A:
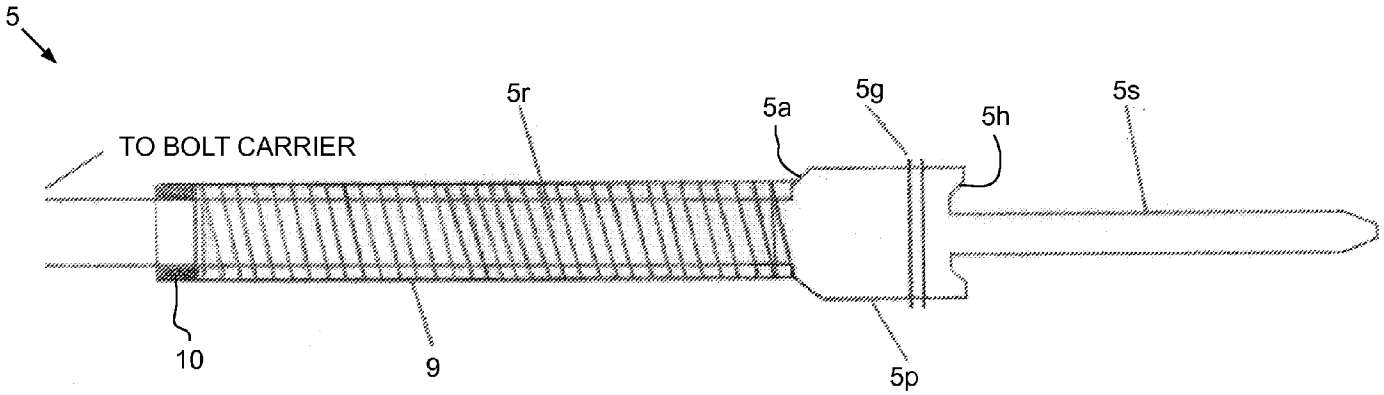
FIG. 3A illustrates a driver of the gas piston system.

FIG. 3A illustrates the driver 5. The driver 5 may further have a hilt 5*h* formed at an interface between the gas piston 5*p* and the stinger 5*s*. The hilt 5*h* may have an inner recess forming a portion of the gas chamber 8 and an outer shoulder for seating against the exhaust head 7*h*. The driver 5 may further include one or more gas rings 5*g*. The gas rings 5*g* may each be a metallic split piston ring carried in a groove formed in an outer surface of the gas piston 5*p* or a seal profile, such as a labyrinth or controlled gap, formed in an outer surface thereof. The driver 5 may further include a return spring 9 disposed along an outer surface of the operating rod 5*r*. The operating rod 5*r* may extend into the upper receiver via a passage formed therethrough to the bolt carrier. The return spring 9 may be disposed between a shoulder 5*a* formed at the interface of the piston 5*p* and rod 5*r* and a washer 10. The washer 10 may be engaged with a catch shoulder (not shown) of the upper receiver.

The gas piston 5*p* of the assembly may form one portion of the gas chamber 8 and may trap the expanding propellant gas in the gas chamber. Pressure of the propellant gas may exert force against the hilt 5*h* and push the driver 5 rearward further into the upper receiver. As the driver 5 moves rearward, the operating rod 5*r* may push on a push pad of the bolt carrier, thereby also moving the bolt carrier rearward and cycling the weapon.

A length of the stinger 5*s* may correspond to a stroke length of the bolt carrier necessary to cycle the weapon such that the stinger 5*s* may open the exhaust channel once the bolt carrier has stroked rearward, thereby allowing the expanding propellant gas to exit the gas chamber 8 through the exhaust head 7*h*, flow through the exhaust channel 7*c*, and be discharged at an exhaust outlet 7*o* away from the receiver and the shooter.

As the driver 5 strokes rearward, the return spring 9 may be compressed between the spring shoulder 5*a* and the keeper 10 such that the spring may return the driver to the forward position as pressure in the gas chamber 8 dissipates. The gas piston system 1 automatically uses only enough of the expanding propellant gas to cycle the weapon (determined by the length of the stinger 5*s*); all of the excess gas not needed is discharged out through the exhaust channel 7*c*.

Figure 3B:
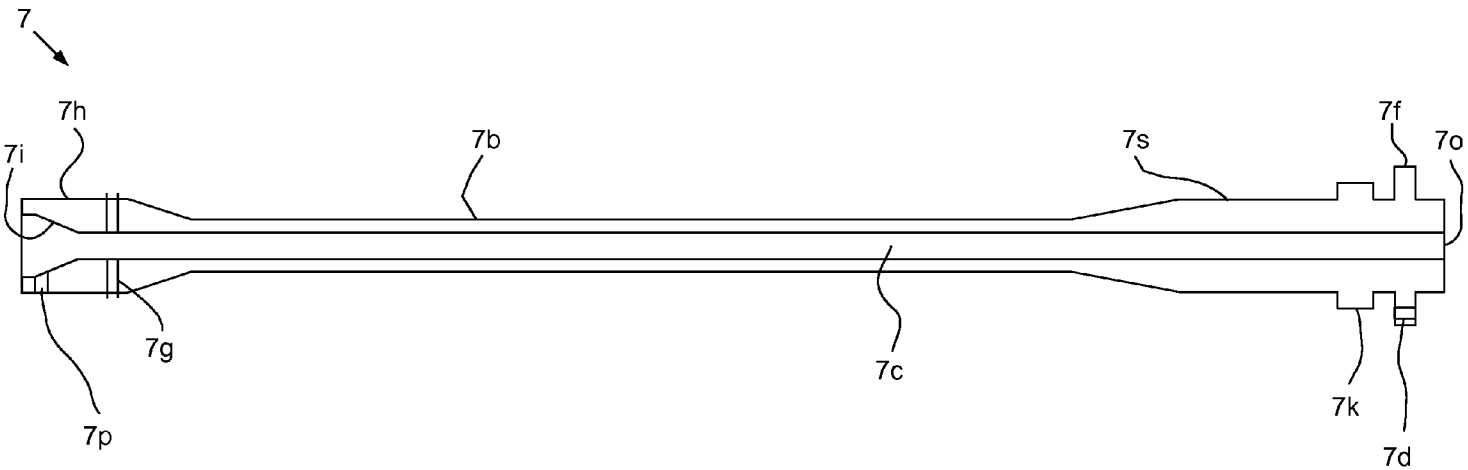
FIG. 3B illustrates an exhaust tube of the gas piston system.

FIG. 3B illustrates the exhaust tube 7. The exhaust head 7*h* may have a conical inner surface 7*i* serving as a portion of the gas chamber 8 and as a guide for receiving the stinger 5*s* into a rear portion of the exhaust channel 7*c*. The exhaust head 7*h* may also have the gas port 7*p* formed through a wall thereof. A rear face of the exhaust head 7*h* may receive the shoulder of the hilt 5*h*. The exhaust tube 7 may also include one or more gas rings 7*g* disposed or formed on an outer surface of the head 7*h*, similar to the gas rings 5*g*. The shoe 7*s* may have a coupling for fastening the exhaust tube 7 to the exhaust block 6. The exhaust tube coupling may be a bayonet type having lugs 7*k* and a flange 7*f* formed in an outer surface of the shoe 7*s* for engagement with a complementary coupling of the exhaust block 6. The exhaust tube coupling may also have a detent socket 7*d* formed through the flange 7*f*.

Figure 4A:
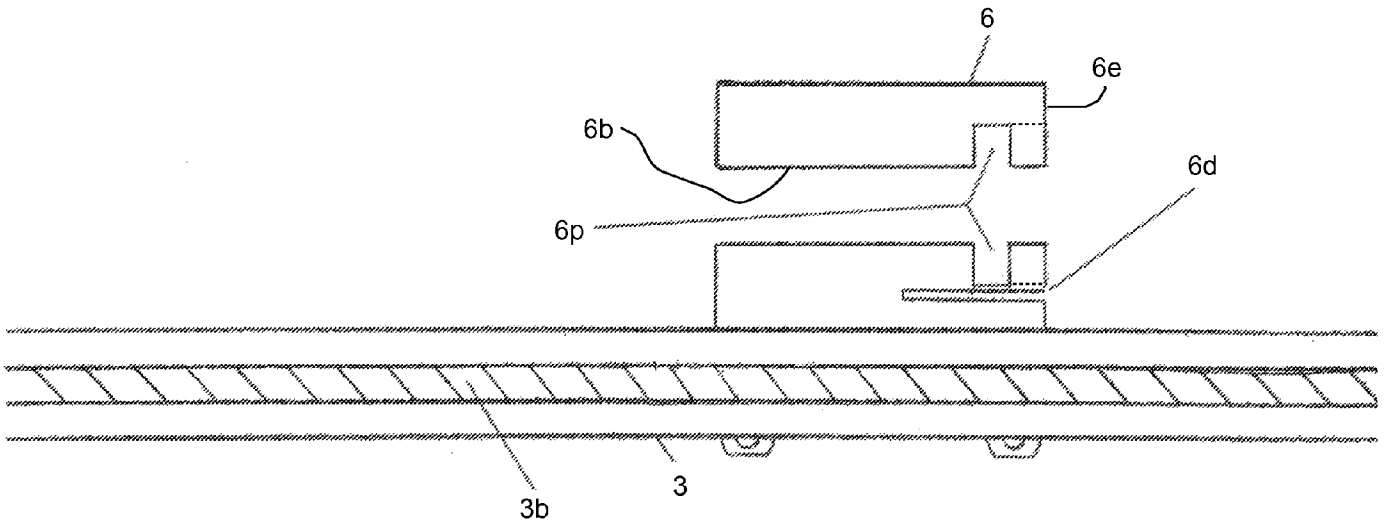
FIG. 4A illustrates an exhaust block of the gas piston system.
Figure 4B:
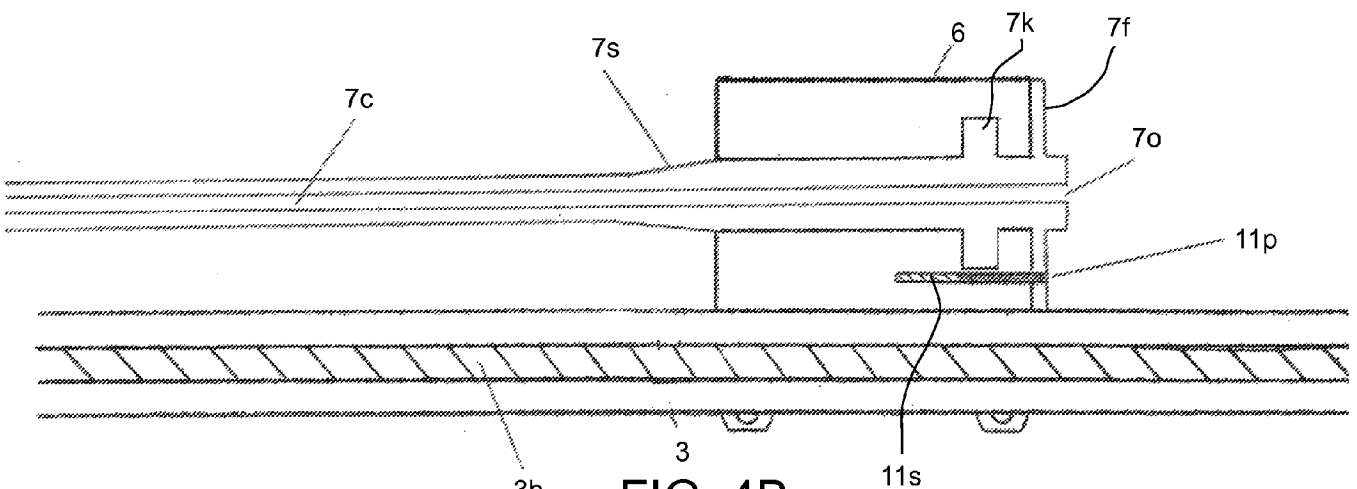
FIG. 4B illustrates the exhaust block assembled with the exhaust tube.

FIG. 4A illustrates the exhaust block 6. FIG. 4B illustrates the exhaust block 6 assembled with the exhaust tube 7. The exhaust block 6 may be mounted near the muzzle and may have a bore 6*b* formed therethrough for passage of the exhaust tube 7 and the coupling for receiving the exhaust shoe 7*s*. The block coupling may have a bayonet profile 6*p* formed in a front end 6*e* thereof for receiving the lugs 7*k*. The lugs 7*k* may be inserted into the bayonet profile 6*p* against the return spring 9 and rotated in the bayonet profile such that the return spring may press the lugs against a locking shoulder of the profile.

The exhaust block 6 may also have a detent socket 6*d* formed in a front end 6*e* thereof. A detent spring 11*s* and a detent plunger 11*p* may be inserted into the detent socket 6*d* just before mounting of the exhaust tube 7. The flange 7*f* may compress the detent plunger 11*p* against the detent spring 11*s* as the lugs 7*k* are inserted into the bayonet profile 6*p* and the flange socket 7*d* may align with the plunger as the lugs are rotated in the profile. The plunger 11*p* may then pop into the flange socket 7*d*, thereby torsionally fastening the exhaust tube 7 to the exhaust block 6.

Due to its low profile design, the exhaust block 6 may also be mounted to the barrel 3 underneath the hand guards or in front of the hand guards. If mounted out in front of the hand guards, the exhaust block 6 may have a mil-standard 1913 rail on the top for mounting sights, or may have a flip up style front sight attached.

To assemble the gas piston system 1, the gas block 4 and the exhaust block 6 may be fastened to the barrel 3. The driver 5 may be inserted first through the exhaust block 6 and then through the gas block 4 until the rear end of the operating rod 5*r* enters the upper receiver and contacts the push pad on the bolt carrier. The exhaust tube 7 may then be inserted through the exhaust block 6 until the head 7*h* enters the gas block 4 and the shoe 7*s* enters the exhaust block 6. The last inch or so of the exhaust tube insertion may compress the return spring 9. The exhaust tube 7 may then be pushed all the way in, making sure to align the locking lugs 7*k* with the bayonet profile 6*p* until the flange 7*f* is in contact with a face of the front end 6*e*. The exhaust tube 7 may then be rotated (i.e., clockwise) by an angle, such as between twenty-five to ninety degrees, until the detent plunger 11*p* engages flange socket 7*d*, thereby indicating that the lugs 7*k* are fully engaged with the bayonet profile 6*p*.

To disassemble the gas piston system 1, a bullet tip or other pointed instrument may be used to depress the detent plunger 11*p* from the flange socket 7*d* so that the exhaust tube 7 may be reversely rotated (i.e., counter clockwise) by the angle to release the lugs 7*k* from the bayonet profile 6*p*. The exhaust tube 7 and then the driver 5 may then be pulled through the exhaust block 6.

Figure 5A:
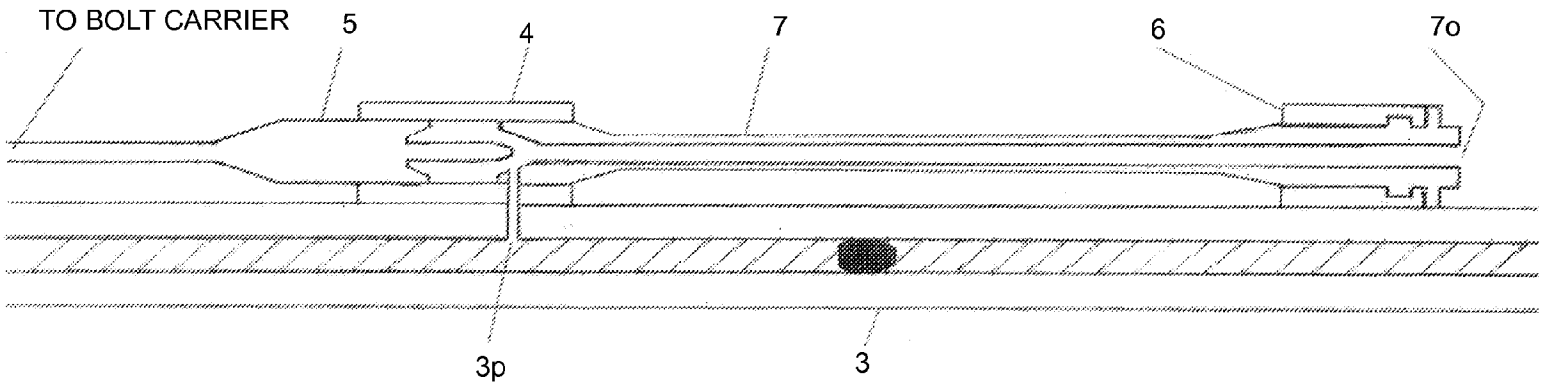
FIGS. 5A and 5B illustrate the gas piston system in a rearward position.
Figure 5B:
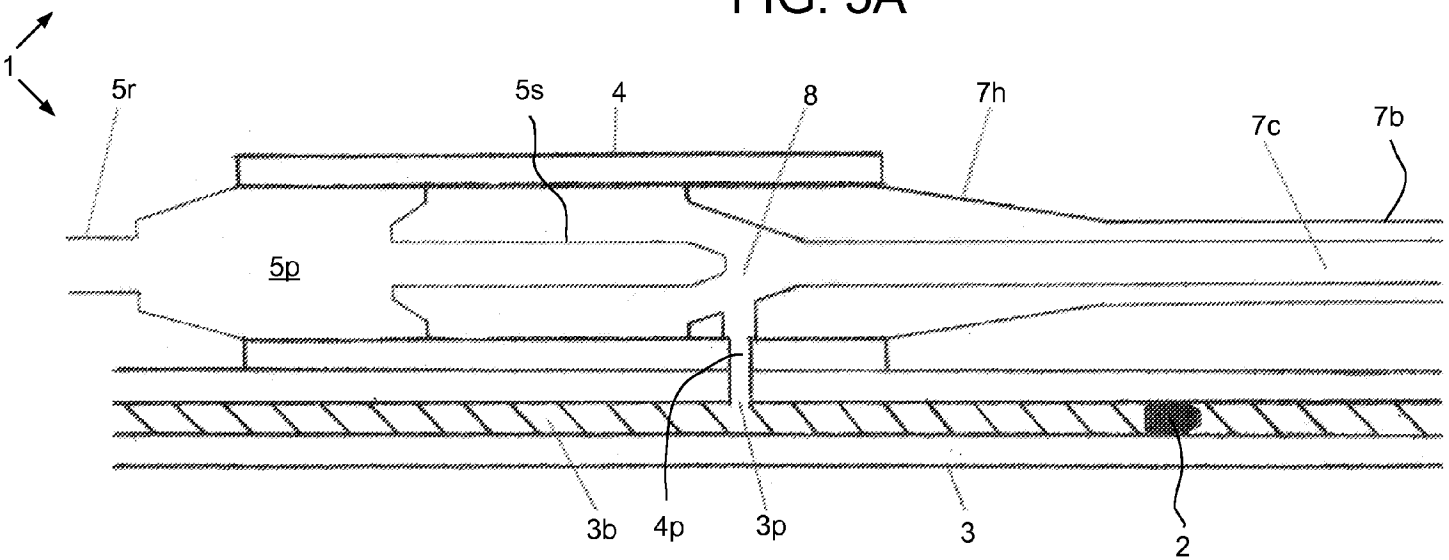

FIGS. 5A and 5B illustrate the gas piston system in a rearward position 1. As shown, the weapon has fired and the bullet 2 is traveling down the rifled bore 3*b* and has just passed the gas port 3*p* but has not yet exited the muzzle. At this point, the gas chamber 8 becomes pressurized and forces the driver 5 to the rear, moving the bolt carrier to the rear and cycling the weapon. As the driver 5 moves to the rear, the stinger 5*s* withdraws from the exhaust channel 7*c*, thereby allowing the expanding propellant gas to be vented from chamber 8, through the gas channel 7*c*, and discharged at the outlet 7*o* at the front of the gas piston system 1. Once the bullet 2 exits the muzzle, the pressure in the gas chamber 8 dissipates such that the return spring 9 may push the driver 5 back to the forward position.

Advantageously, the gas piston system 1 for the M16/AR15 rifle or M4 carbine comes from previous experience in designing larger caliber cartridges for this weapon. The shortcomings of existing gas piston systems for this weapon system when chambered in non-standard calibers were noted early on and all attempts to modify them to operate with larger calibers failed. What was needed was a design that would work with any caliber, any barrel length, and with the weapon suppressed or unsuppressed and be reliable. The gas piston system 1 may be used with a suppressor as is or the flange 7*f* may be modified to include a second detent socket to misalign the gas port 7*p* with the gas port 4*p* for a specialized suppressor mode. The gas piston system 1 is a product improvement over all existing gas piston systems currently available for the AR15 rifle.

Figure 6A:
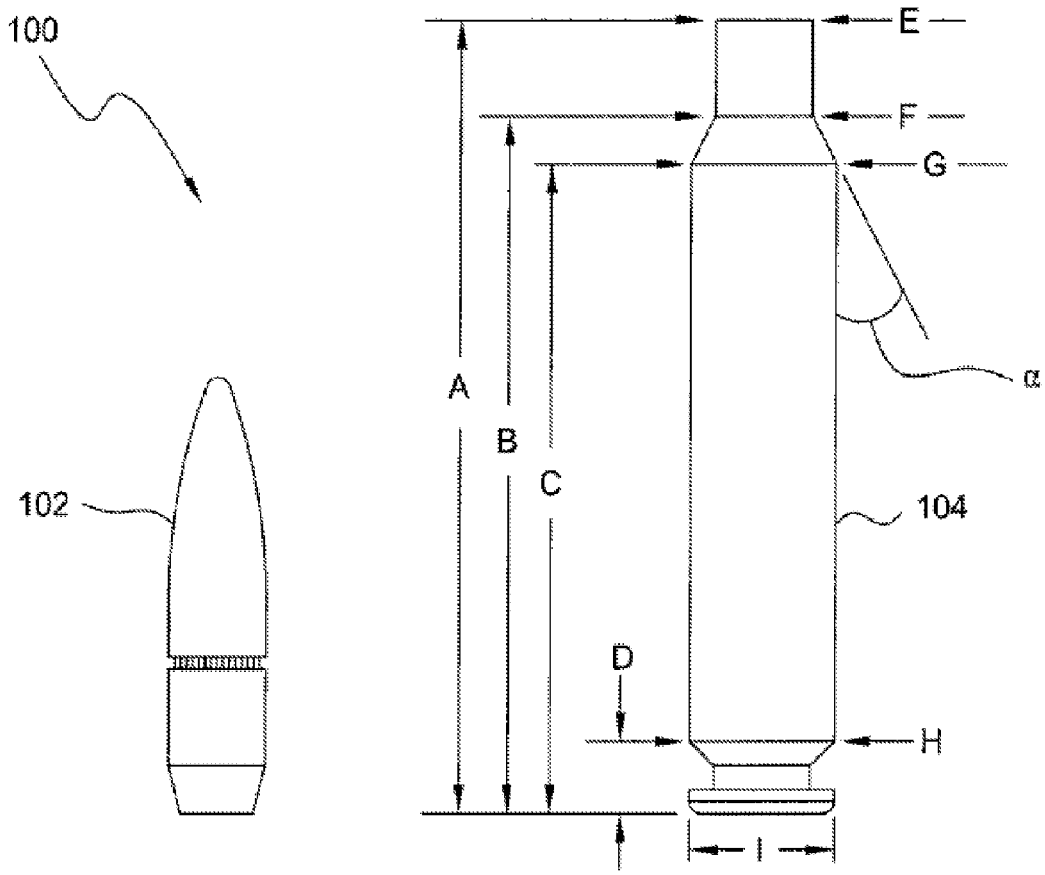

FIGS. 6A-6C illustrate cartridges 100 suitable for use with the gas piston system 1. Each cartridge 100 may include a bullet 102, a case 104, a charge of gunpowder, and a primer. The cartridges 100 listed in FIG. 6B are usable with the existing M16/AR15 rifle or M4 upper receiver, requiring only a modified barrel, as discussed in US Pat. App. Pub. Nos. 2009/0211483, which is herein incorporated by reference. The cartridges 100 listed in FIG. 6C are usable with only slight modification to the existing M16/AR15 rifle or M4 upper receiver (with a modified barrel), as discussed in US Pat. App. Pub. No. 2011/0005383, which is herein incorporated by reference.

In addition to the cartridges 100, the gas piston system 1 may be used with the standard 223 Remington/5.56 mm NATO cartridges or any other supersonic or subsonic cartridges usable with an AR15 style rifle or carbine. The gas piston system 1 is streamlined and smaller in size than most other systems, which allows it to be concealed under the hand guards. The ability of this system to be concealed allows the gas block 4 and the exhaust block 6 to be located anywhere along the barrel 3; this feature allows the system to be adaptable to any cartridge and barrel length combination desired. Unlike all other gas piston systems that discharge the propellant gases at the gas piston or gas block location, the gas piston system 1 discharges the propellant gas out of the system to the front of the weapon near the muzzle (front discharge), keeping them away from the weapon and the shooter. The gas piston system 1 is also adaptable to very short or long barrels and those weapons using suppressors. Because the gas piston system 1 discharges all excess gasses not used to cycle the weapon automatically, the use of a suppressor on a weapon equipped with this system will not alter its performance.

The gas piston system 1 is more versatile and cleaner than any other system currently available. The entire gas piston system 1: fits under the hand guards (concealed), works with all calibers and loads, works with all barrel lengths, works in normal and suppressed firing modes (automatically adjusts), and keeps propellant gas out and away from the weapon and shooter (front discharge).

While the foregoing is directed to embodiments of the present disclosure, other and further embodiments of the disclosure may be devised without departing from the basic scope thereof, and the scope of the invention is determined by the claims that follow.

What is claimed is:

1. A firearm, comprising:
a barrel having a port formed through a wall thereof;
a bolt carrier assembly operable to:
transport a cartridge from a magazine to the barrel, and eject the spent cartridge from the barrel; and
a gas piston system comprising:
a gas block having a port in communication with the barrel port;
an exhaust tube having:
a head at least partially disposed in the gas block and having a port in fluid communication with the gas block port;
a body extending from the head toward a muzzle of the firearm; and
a channel extending from the exhaust tube port through the body; and
a driver movable relative to the gas block between a forward and rearward position and having:
a piston slidable along the gas block;
a stinger closing the channel in the forward position and opening the channel in the rearward position, and
an operating rod operable to push the bolt carrier assembly away from the barrel,
wherein:
the gas block is fastened to the barrel,
the exhaust tube further has a shoe having a coupling, and
the gas piston system further comprises an exhaust block fastened to the barrel and having a coupling engaged with the shoe coupling.

2. The firearm of claim 1, wherein:
the gas block is fastened to the barrel near a firing chamber, and
the exhaust block is fastened to the barrel near the muzzle.

3. The firearm of claim 1, wherein:
the shoe coupling has a plurality of lugs, and
the block coupling has a bayonet profile formed therein receiving the lugs.

4. The firearm of claim 3, wherein:
the shoe coupling further has a flange having a socket,
the block coupling further has a socket, and
the gas piston system further comprises a detent engaged with the sockets.

5. The firearm of claim 1, wherein:
the driver further has a hilt formed at an interface of the piston and the stinger,
the hilt has a recess forming a portion of a gas chamber, and
the exhaust head has a conical inner surface forming another portion of the gas chamber.

6. The firearm of claim 1, wherein the gas piston system further comprises a return spring disposed along an outer surface of the operating rod.

7. The firearm of claim 1, wherein each of the piston and the head have one or more gas rings for engaging an inner surface of the gas block.

8. The firearm of claim 1, wherein a length of the stinger corresponds to a stroke length of the bolt carrier assembly.

9. A gas piston system comprising:
a gas block for mounting to a barrel of a firearm and having a port for communication with a port of the barrel;
an exhaust tube having:
a head at least partially disposed in the gas block and having a port in fluid communication with the gas block port;
a body extending from the head to a shoe;
the shoe having a coupling; and
a channel extending from the exhaust tube port through the body and the shoe;
an exhaust block for mounting to the barrel and having a coupling engaged with the shoe coupling;
a driver movable relative to the gas block between a forward and rearward position and having:
a piston slidable along the gas block;
a stinger closing the channel in the forward position and opening the channel in the rearward position, and
an operating rod for extending to a bolt carrier assembly of the firearm; and
a gas chamber formed in the gas block between the piston and the head.

10. The gas piston system of claim 9, wherein:
the shoe coupling has a plurality of lugs, and
the block coupling has a bayonet profile formed therein receiving the lugs.

11. The gas piston system of claim 10, wherein:
the shoe coupling further has a flange having a socket,
the block coupling further has a socket, and
the gas piston system further comprises a detent engaged with the sockets.

12. The gas piston system of claim 9, wherein:
the driver further has a hilt formed at an interface of the piston and the stinger,
the hilt has a recess forming a portion of the gas chamber, and
the head has a conical inner surface forming another portion of the gas chamber.

13. The gas piston system of claim 9, further comprising a return spring disposed along an outer surface of the operating rod.

14. The gas piston system of claim 9, wherein each of the piston and the head have one or more gas rings for engaging an inner surface of the gas block.

15. A firearm, comprising:
a barrel having a port formed through a wall thereof;
a bolt carrier assembly operable to:
transport a cartridge from a magazine to the barrel, and eject the spent cartridge from the barrel; and
a gas piston system comprising:

a gas block having a port in communication with the barrel port;

an exhaust tube having:

a head at least partially disposed in the gas block and having a port in fluid communication with the gas block port;

a body extending from the head toward a muzzle of the firearm; and a channel extending from the exhaust tube port through the body; and a driver movable relative to the gas block between a forward and rearward position and having:

a piston slidable along the gas block;

a stinger closing the channel in the forward position and opening the channel in the rearward position, and an operating rod operable to push the bolt carrier assembly away from the barrel, wherein:

the driver further has a hilt formed at an interface of the piston and the stinger, the hilt has a recess forming a portion of a gas chamber, and the exhaust head has a conical inner surface forming another portion of the gas chamber.

* * * * *